US008444398B2

(12) United States Patent
Brunet et al.

(10) Patent No.: US 8,444,398 B2
(45) Date of Patent: May 21, 2013

(54) PUMP MANIFOLD SUPPORT

(75) Inventors: John Dexter Brunet, Duncan, OK (US); Justin Lee Hurst, Loco, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 302 days.

(21) Appl. No.: 13/077,332

(22) Filed: Mar. 31, 2011

(65) Prior Publication Data

US 2012/0247578 A1 Oct. 4, 2012

(51) Int. Cl.

| | |
|---|---|
| ***F04B 51/00*** | (2006.01) |
| ***F04B 53/22*** | (2006.01) |
| ***F16K 51/00*** | (2006.01) |
| ***B23P 6/00*** | (2006.01) |
| ***F16M 11/00*** | (2006.01) |

(52) U.S. Cl.
USPC ... 417/454; 417/572; 137/15.18; 137/315.33; 29/888.021; 248/201

(58) Field of Classification Search
USPC ..... 417/454, 568, 572; 137/15.18, 315.33; 29/888.021; 248/201
See application file for complete search history.

(56) References Cited

U.S. PATENT DOCUMENTS

| | | | | |
|---|---|---|---|---|
| 4,333,729 | A * | 6/1982 | Marugg | 417/313 |
| 4,878,815 | A * | 11/1989 | Stachowiak | 417/63 |
| 5,846,056 | A * | 12/1998 | Dhindsa et al. | 417/44.2 |
| 6,796,321 | B2 * | 9/2004 | Vicars | 137/70 |
| 7,335,002 | B2 | 2/2008 | Vicars | |
| 7,341,435 | B2 * | 3/2008 | Vicars | 417/360 |
| 7,484,452 | B2 * | 2/2009 | Baxter et al. | 92/169.1 |
| 8,105,055 | B2 * | 1/2012 | Small | 417/454 |
| 8,172,523 | B2 * | 5/2012 | Towsley et al. | 415/198.1 |

* cited by examiner

*Primary Examiner* — Charles Freay
(74) *Attorney, Agent, or Firm* — John W. Wustenberg; Fish & Richardson P.C.

(57) ABSTRACT

A pump has a pump fluid end and a manifold that is detachable from the fluid end. A device is attachable to the pump, and has a manifold support beam portion adapted to affix to the pump fluid end at a location adjacent a manifold mating surface of the pump fluid end and extend outward from the pump fluid end. A support is provided on the manifold support beam portion that, when the manifold support beam portion is affixed to the fluid end of the pump, engages the manifold detached from the fluid end and supports the weight of the manifold.

20 Claims, 7 Drawing Sheets

PUMP MANIFOLD SUPPORT

BACKGROUND

This disclosure relates to pumps used in oil and gas drilling and production operations.

High pressure pumps are used in many aspects of drilling and production operations in the oil and gas industry. Some parts of the pumps are susceptible to wear especially when pumping abrasive or corrosive fluids used in well completions and stimulation work often referred to in the industry as "hydraulic fracturing" or "frac jobs" or recently "fracking". "Fracturing" is an abbreviation for a stimulation treatment wherein fluid (with or without proppant) is pumped at high pressures into downhole geologic formations to enhance the production of hydrocarbons from the treated geologic formation. The pump parts undergo mechanical wear under extreme conditions of stress and need to be frequently changed. The frequent change of parts leads to loss in productivity due to equipment downtime. Changing the parts is hindered by the fact that, often, the work must be performed at the well site or otherwise outside of a well-equipped workshop.

SUMMARY

This disclosure relates to pumps used in oil and gas drilling and production operations, and describes a device and its use in servicing such pumps.

The disclosure encompasses a device attachable to a pump. The pump is of a type having a pump fluid end and a manifold that is detachable from the fluid end. The device has a manifold support beam portion adapted to affix to the pump fluid end at a location adjacent a manifold mating surface of the pump fluid end and extend outward from the pump fluid end. A support is provided on the manifold support beam portion that, when the manifold support beam portion is affixed to the fluid end of the pump, engages the manifold detached from the fluid end. The support supports the weight of the manifold in a first position with a pump body mating surface of the manifold adjacent a manifold mating surface and guides the manifold, still supported, to slide to a second position, apart from the manifold mating surface.

The disclosure encompasses a pump having a fluid end with a manifold mating surface surrounding a pump fluid port. A manifold is adapted to be affixed to the pump fluid end by a fastener and has a pump mating surface. The pump mating surface is adapted to abut and seal with the manifold mating surface to enable communication of fluid between the pump fluid end and the manifold via the pump fluid port. A manifold support extends outward from the pump fluid end. The manifold support is shaped to engage the manifold when detached from the fluid end. The manifold support supports the weight of the manifold in a first position with the manifold upright and the pump mating surface adjacent the manifold mating surface. The manifold support surface guides the manifold, still supported, to move to a second position with the manifold upright and the pump mating surface apart from the manifold mating surface.

The disclosure encompasses a method of servicing a pump. In the method a manifold of the pump is disconnected from a remainder of the pump. The manifold is supported in an orientation adjacent a manifold mating surface on a manifold support of the pump. The manifold is displaced from the manifold mating surface while the manifold is supported in the same orientation on the manifold support. In certain instances, the orientation is upright.

In certain instances, the manifold mating surface and the pump fluid end mating surface can be substantially planar and the pump fluid end mating surface can be supported oriented toward and substantially parallel to the manifold mating surface when in the first position. The pump fluid end mating surface can be substantially parallel to the manifold mating surface when in the second position. In certain instances, the manifold support can include a track for engaging both an upward facing and a downward facing surface of the manifold. The manifold can include a flange and the track can be configured to engage upward facing and downward facing surfaces of the flange. Certain configurations of the track include a plurality of support pins arranged in a line and positioned to enable the flange to rest on the support pins when the manifold is supported by the manifold support. The support pins can be rollers. In certain instances, the manifold support guides the manifold to move in a substantially straight path between the first and second position. In certain instances, the manifold support guides the manifold, still supported, to move to a third position apart from the manifold mating surface and on an opposite side of the manifold mating surface from the second position. In certain instances, the manifold support can include provisions to lock the manifold in the second position.

The details of one or more embodiments are set forth in the accompanying drawings and the description below. Other features, objects, and will be apparent from the description and drawings, and from the claims.

DESCRIPTION OF DRAWINGS

Like reference symbols in the various drawings indicate like elements.

DETAILED DESCRIPTION

Figure 1A:
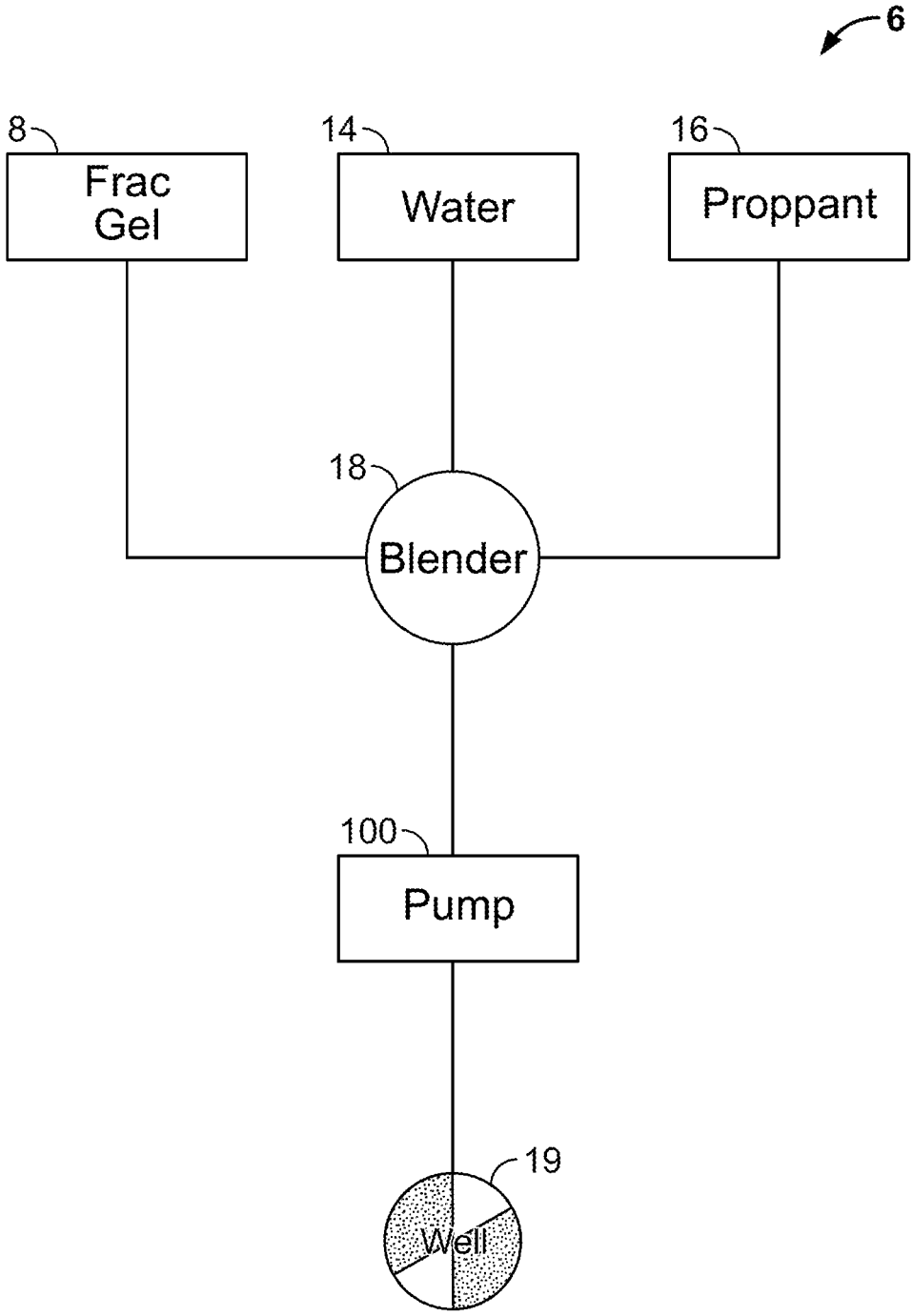
FIG. 1A is a schematic of a typical fracking operation.

Referring first to FIG. 1A, a schematic of a typical fracking operation 6 is shown. In the schematic, frac gel 8, water 14 and proppant 16 are mixed at a blender 18 and pumped into a well 19 by a high pressure pump 100. The pump 100, in many instances, is a reciprocating plunger type pump.

Figure 1B:
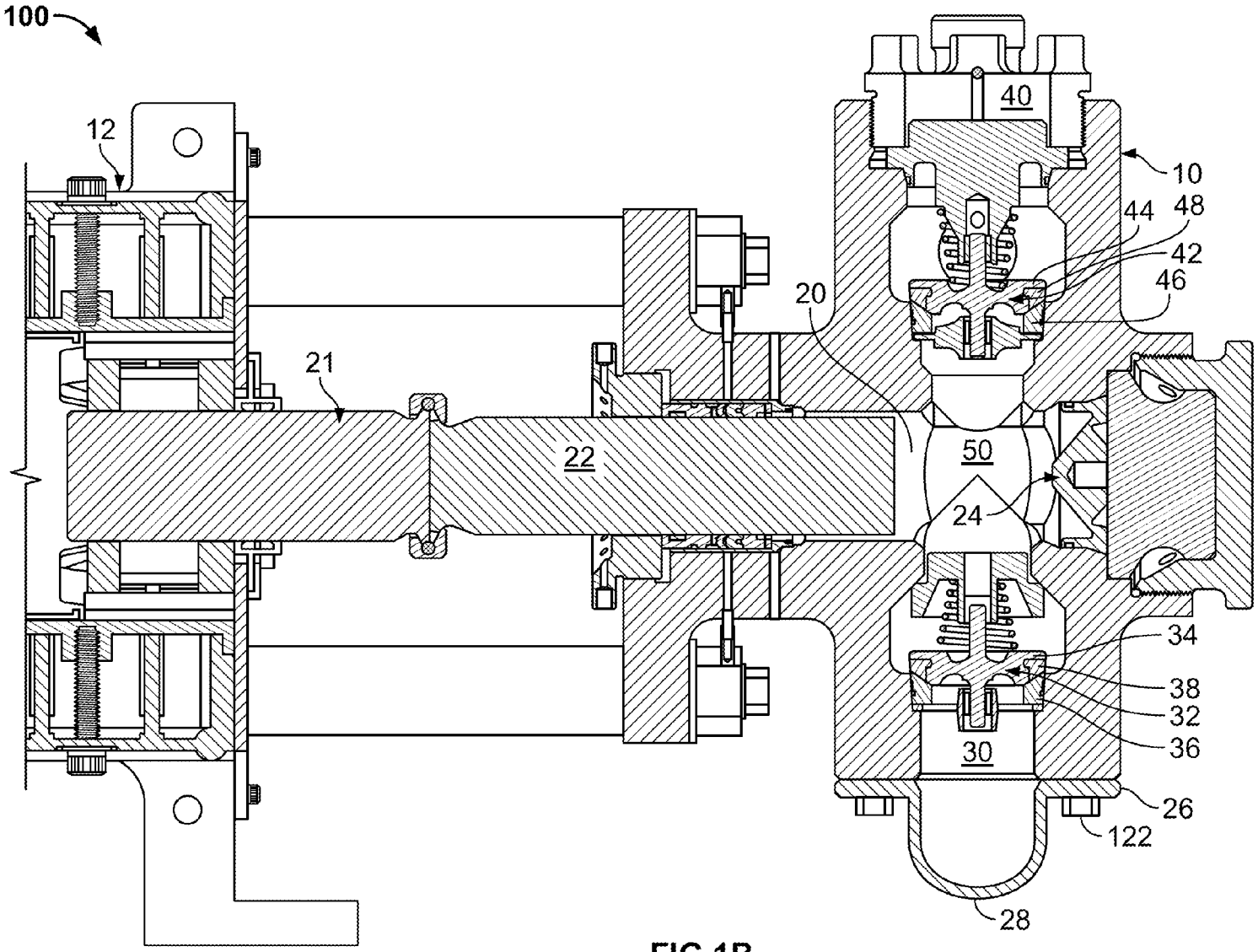
FIG. 1B is a side cross-sectional view of an example reciprocating plunger type pump.

FIG. 1B, by way of example but not by way of limitation, is a cross-sectional view of a high pressure, reciprocating plunger pump 100. This particular embodiment is a pump manufactured by, Halliburton, but the concepts herein are applicable to many other different models and configurations of reciprocating plunger pumps, as well as to other configurations of pumps, compressors, mixers and other like devices.

The pump 100 includes a power end section 12 and a fluid end section 10. The power end section 12 includes a mechanical driver connected to one or more push rods 21 which, in turn, are connected to a corresponding number of plungers 22. The fluid end section 10 includes one or more cylinders 20, plungers 22 slidably disposed in the cylinders, and cylinder head covers 24. An inlet bore 30 that receives fluid from a suction manifold 28 is fluidly connected to each cylinder 20.

The suction manifold 28 receives fluid and divides it among the inlet bores 30. The suction manifold 28 has a flat flange 26 with a fluid end mating surface that abuts and seals (e.g., via a gasket, o-ring and/or other seal) with a corresponding manifold engaging surface of the fluid end section 10. Fasteners 122 (e.g., bolts, studs and/or other fasteners) extend through the flange 26 into the fluid end section 10 and attach the suction manifold 28 to the fluid end section 10.

The inlet bore 30 has a suction valve 32 disposed in the inlet bore. The suction valve includes a suction valve closure member 34 and a suction valve seat 36. The pump 100 further includes an outlet bore 40 fluidly connected to the cylinder 20. The outlet bore has a discharge valve 42 disposed therein. The discharge valve includes a discharge valve closure member 44 and a discharge valve seat 46. The pump includes at least one valve insert 38, 48 disposed on at least one valve closure member 34 and 44 respectively.

In operation, the power end 12 moves the reciprocating plunger(s) 22. As the plunger 22 is withdrawn from a cylinder bore(s) 20 in the fluid end section 10, a partial suction is created. The suction valve closure member 34 is drawn up and away from its seat 36, allowing fluid from the suction manifold 28 to enter a fluid chamber 50 in the fluid end 10. At the same time, fluid already in the fluid chamber 50 moves in to fill the space where the plunger 22 was in the cylinder 20.

As the plunger re-enters the fluid end section 10, the fluid is pressurized. Fluid would go out the way it entered the chamber 50, but the suction valve closure member 34 moves into contact with the seat 36. As pressure increases, the fluid pressure forces the discharge valve 42 to open. The discharge valve closure member 44 moves up off its seat 46 and the fluid is expelled from the chamber 50. Loss of pressure inside the chamber and the discharge valve closure member 44 moves down to form a seal with its seat 46, wherein the cycle begins again.

Figure 2A:
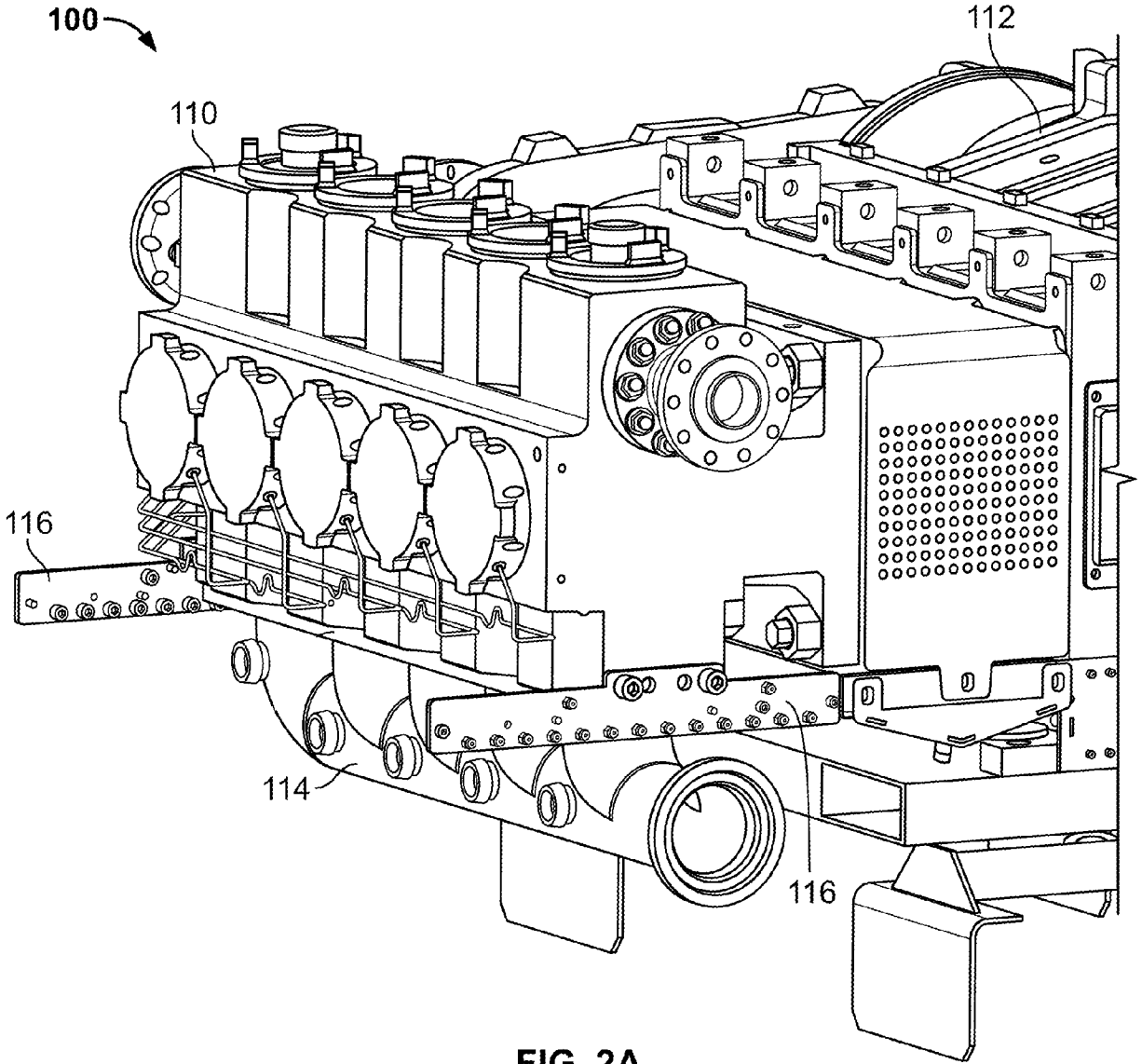
FIGS. 2A-2B are perspective views of an example reciprocating plunger type pump including a manifold support.
Figure 2B:
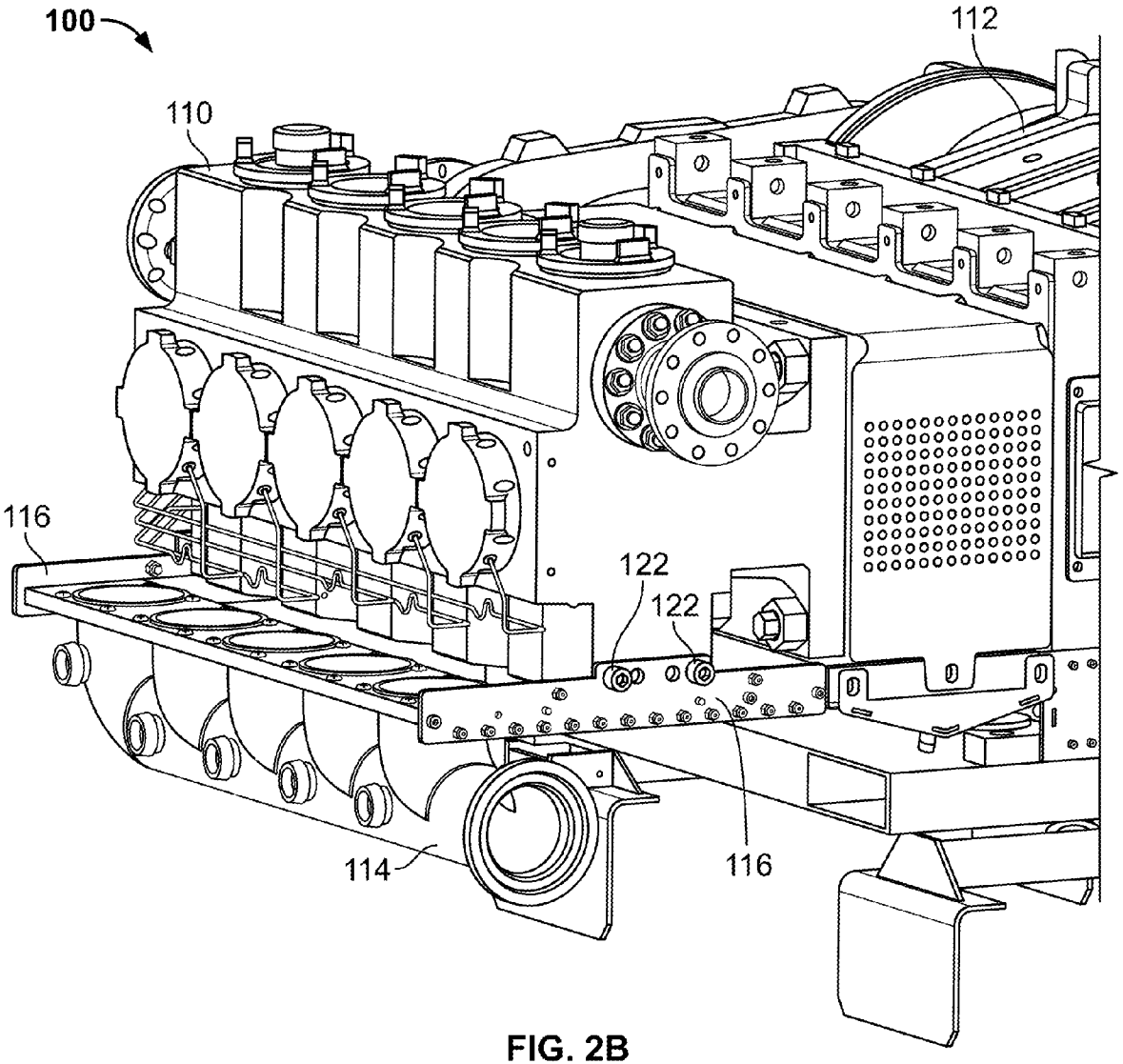

FIGS. 2A and 2B show an exterior perspective view of a plunger pump 100 with manifold supports 116 installed on both sides of the fluid end 110. The manifold supports 116 are shaped to engage the manifold 114 when it is detached from the fluid end 110. As seen in FIG. 2A, the supports 116 support the weight of the manifold in a position with the manifold upright and the pump body mating surface of the manifold adjacent to the manifold mating surface of the fluid end 110. This allows technician to release the fasteners holding the manifold 114 to the fluid end 110 and drop the manifold 114 just a small amount to be supported on the manifold supports 116. In certain instances, the manifold supports 116 engage and support the weight of the manifold 114 before the fasteners are fully released from the fluid end 110. For example, in the case of bolts, the technician would unscrew the bolts until the manifold supports 116 engage and fully support the weight of the manifold 114, and then continue to unscrew the bolts until they are removed from the fluid end 110. In such an instance, the technician would not need to lift or otherwise support the manifold, thus greatly reducing the risk of injury (i.e., is safer) and eliminating the inconvenience of needing a jack, hoist, come-along or similar device to manipulate the manifold. The manifold supports 116 can be configured to maintain the manifold 114 upright, as in FIG. 2A, and with the pump fluid end mating surface of the manifold 114 oriented toward and substantially parallel to the manifold mating surface of the fluid end 110.

Once engaging the manifold 114, the supports 116 guide the manifold 114, still supported, as the technician moves the manifold 114 away from the fluid end 110 to a position where the pump body mating surface of the manifold 114 is apart from the manifold mating surface of the fluid end 110. In FIG. 2B, the manifold 114 is maintained upright and the pump fluid end mating surface of the manifold 114 is maintained substantially parallel to the manifold mating surface of the fluid end 110. The manifold supports 116 are long enough that the manifold 114 can be moved to a position where the technician can have clear access the internals of the fluid end 110 through the inlet bore and to use tools, relatively unobstructed, in doing so. This enables the technician to service components such as the suction and discharge valves discussed above, for example to replace the sealing surfaces of the valve closure members and seats, and to use appropriate tools in doing so. When the service is complete, the technician moves the manifold 114 back, guided and supported by the manifold supports 116. The supports 116 support the weight of the manifold in a position with the manifold upright and the pump body mating surface of the manifold adjacent to the manifold mating surface of the fluid end 110. This allows the technician to easily engage the fasteners to the fluid end 110 without having to lift the manifold 114. As above, because the technician would not need to lift or otherwise support the manifold, the risk of injury would be greatly reduced.

As can be seen from FIG. 2B, in some configurations, the supports 116 guide the manifold 114 to be moved to either side of the fluid end 110. For example, the manifold 114 can be moved away from the power end section 112 and out from under the fluid end 110, so that the fluid end mating surface of the manifold 114 is exposed from above and unobstructed by the fluid end 110. This position would allow a technician ready access to clean the upward facing surface of the manifold 114 and replace the seals therein. Alternately, the manifold 114 can be moved in an opposite direction, toward the power end section 112. This position may allow the technician more unobstructed access to the internals of the fluid end 110. Some configurations of the manifold supports 116 only guide the manifold 114 to be moved to one side of the fluid end 110.

Figure 2C:
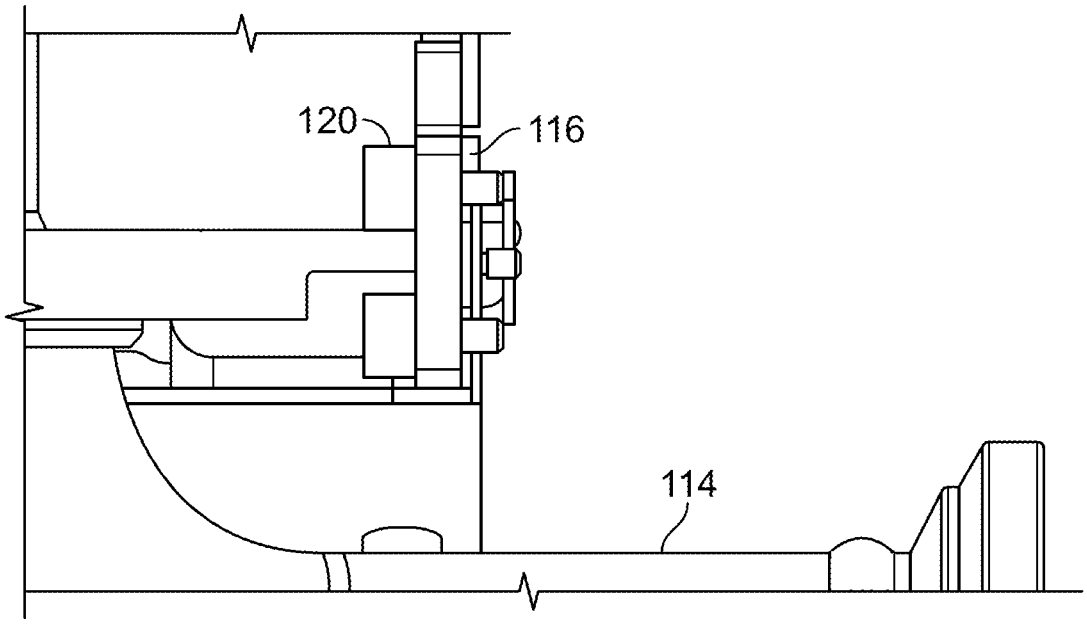
FIG. 2C is a detail end view of the manifold flange to manifold support interface of the pump of FIGS. 2A-2B.
Figure 3A:
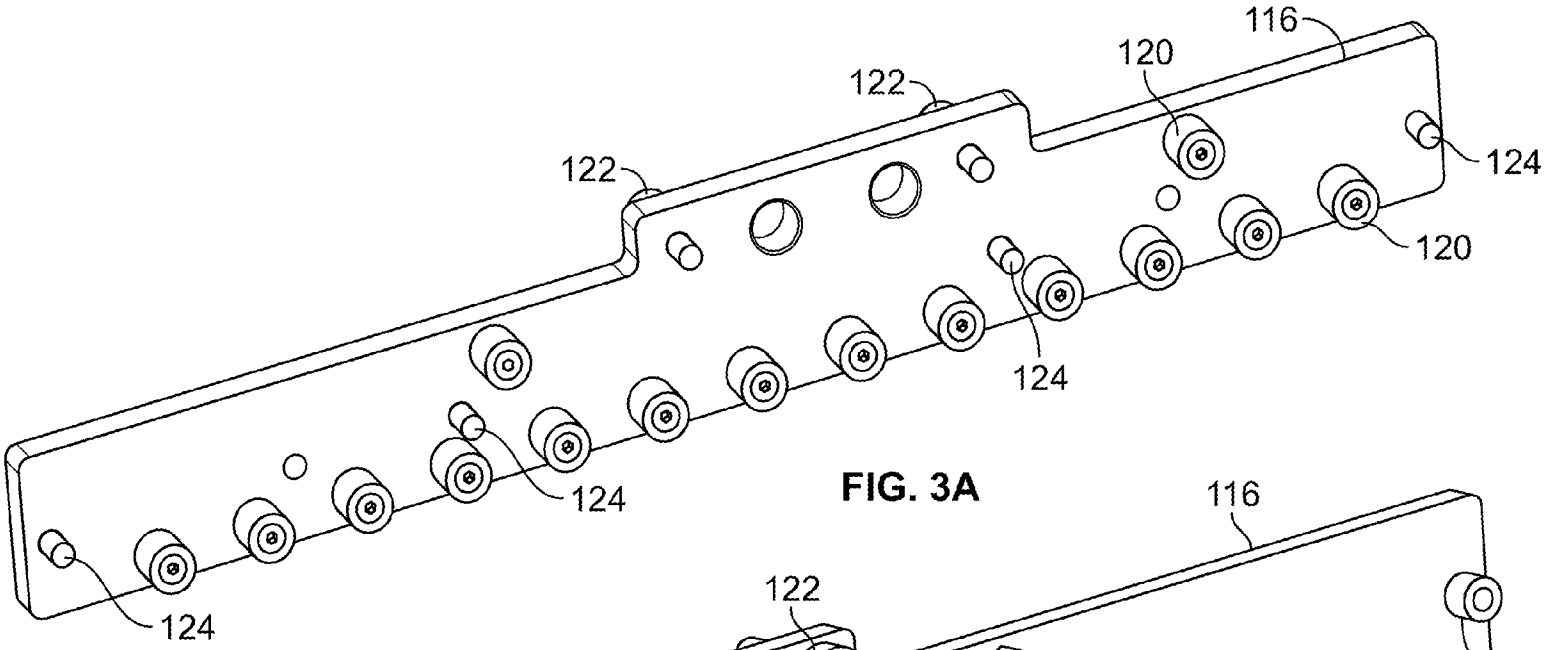
FIGS. 3A-3B are perspective views of an example manifold support.
Figure 3B:
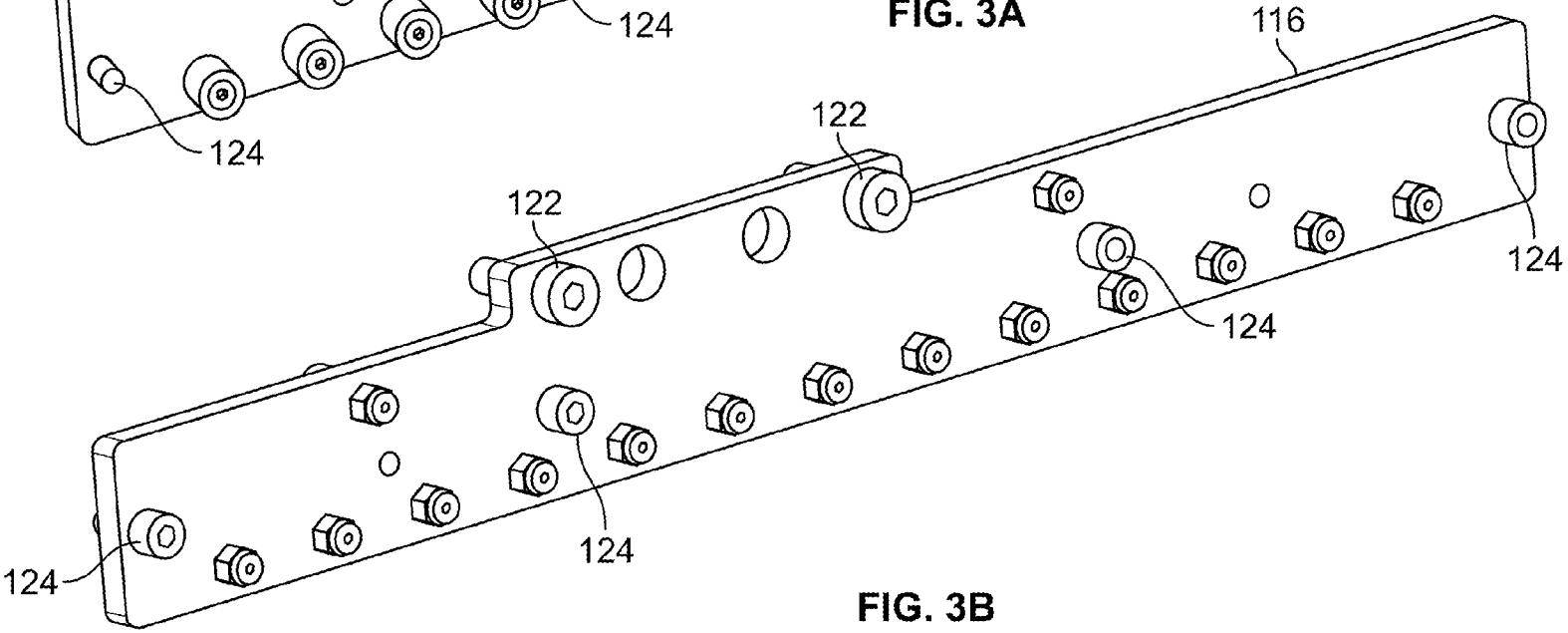
Figure 4A:
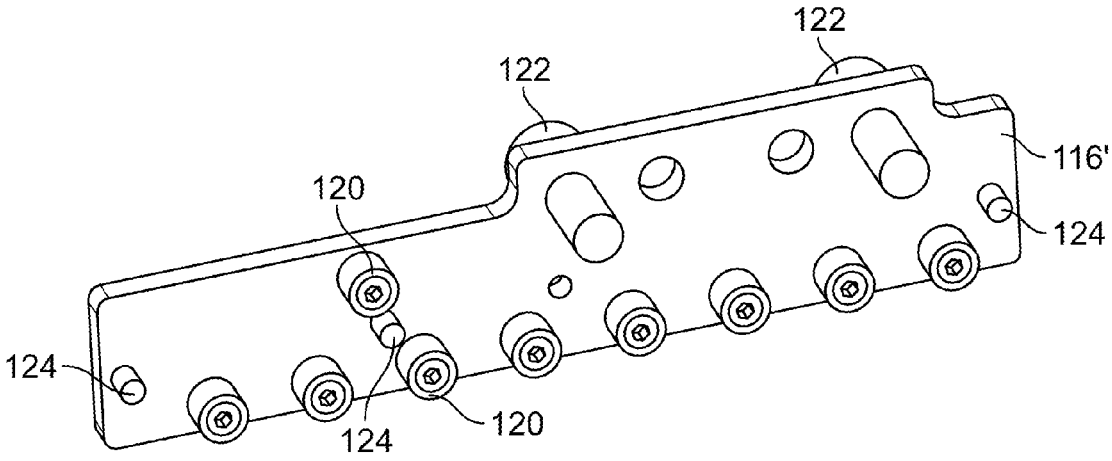
FIGS. 4A-4B are perspective views of another example manifold support.
Figure 4B:
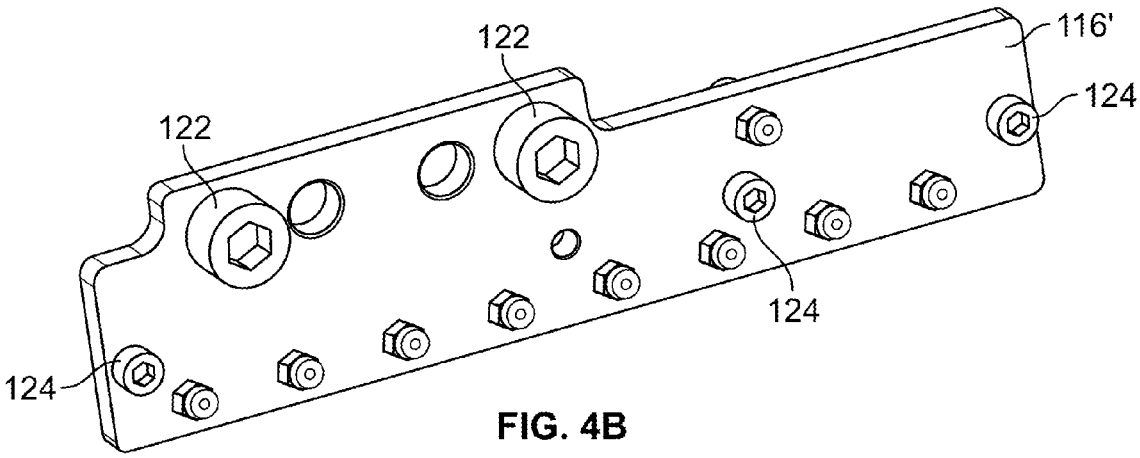

FIGS. 3A and 3B show, in more detail, a configuration of manifold support 116 that guides the manifold to be moved to either side of the fluid end. FIGS. 4A and 4B show, in more detail, a configuration of manifold support 116' that only guides the manifold to be moved to one side of the fluid end. The manifold support 116' can be installed either oriented toward the power end or away from the power end, depending on which direction it is desired to move the manifold. The manifold supports 116, 116' can have a beam portion made of flat plate and a support that engages the manifold can be a number of pins 120, for example roller pins, arranged along the length of the beam portion. Some of the pins 120 are arranged in a line near the bottom of the manifold support 116, 116' and arranged to engage and support a downward facing surface of the flange on the manifold (FIG. 2C). The remainder of the pins 120 are near the top of the manifold support 116, 116' to engage an upward facing surface of the flange on the manifold (FIG. 2C). In certain instances, the flange on the manifold may have an extension specifically to be engaged by the pins 120. Together, the top and bottom pins 120 define a track that guide the manifold 114 in a straight line and maintain the manifold 114 upright when it is moved. In other instances, the track could be differently configured, for example, as a single side (e.g., with the upper pins omitted). Also, fixed pins or plates that define slides could be used in lieu of the roller pins, the track could be a groove cut into the plate, or the supports could be another configuration. In yet another configuration, the flange of the manifold could have pins (roller or fixed) that engage a plate on the manifold support.

The manifold supports 116, 116' can also have provisions to control the extent of movement of the manifold. For example, the figures show bolts 124 that can be threaded through the beam portion and into the path of the manifold. There are bolts 124 at both ends of the manifold support 116, 116' that limit the range of motion of the manifold and keep the manifold from sliding off an end of the supports. There are bolts 124 intermediate the ends that are positioned to lock the manifold from moving when apart from the manifold mating surface of the fluid end. For example, when the manifold is being moved on the manifold supports 116, 116', the bolts 124 intermediate the ends would be unscrewed so that they do not protrude into the path of the manifold. Once the manifold has been moved apart from the manifold mating surface of the fluid end, a bolt 124 can be threaded into the path of the manifold intermediate the ends to trap the manifold flange between the intermediate bolt 124 and the bolt 124 at the end of the manifold support.

Referring back to FIGS. 2A and 2B, the manifold supports 116 are shown attached to the fluid end 110 with fasteners 122. This allows the manifold supports 116 to be installed only when a service is to be performed on the pump 100, and removed at other occasions. Alternately, the manifold supports 116 can left on the pump 100. For example, in configurations such as that of FIGS. 4A and 4B, the manifold supports 116' can be installed oriented toward the power end section 112 so they do not protrude out from the fluid end 110 and thus are more appropriate for leaving on the pump 100. Additionally, the manifold supports 116 can be retrofitted to pumps that were not originally provided with them. In other instances, the manifold supports 116 can be permanent, for example, welded or otherwise integral to the fluid end 110.

A number of embodiments have been described. Nevertheless, it will be understood that various modifications may be made. According, other embodiments are within the scope of the following claims.

What is claimed is:

1. A pump, comprising:

a pump fluid end having a manifold mating surface surrounding a pump fluid port;

a manifold adapted to be affixed to the pump fluid end by a fastener and having a pump mating surface adapted to abut and seal with the manifold mating surface to enable communication of fluid between the pump fluid end and the manifold via the pump fluid port; and a manifold support extending outward from the pump fluid end, the manifold support shaped to engage the manifold when detached from the fluid end and:

support the weight of the manifold in a first position with the manifold upright and the pump mating surface adjacent the manifold mating surface, and guide the manifold, still supported, to move to a second position with the manifold upright and the pump mating surface apart from the manifold mating surface.

2. The pump of claim 1, wherein the manifold mating surface and the pump fluid end mating surface are substantially planar and the pump fluid end mating surface is supported oriented toward and substantially parallel to the manifold mating surface when in the first position.

3. The pump of claim 2, wherein the pump fluid end mating surface is substantially parallel to the manifold mating surface when in the second position.

4. The pump of claim 1, wherein the manifold support comprises a track for engaging both an upward facing and a downward facing surface of the manifold.

5. The pump of claim 4, wherein the manifold comprises a flange and the track engages upward facing and downward facing surfaces of the flange.

6. The pump of claim 5, wherein the track comprises a plurality of support pins arranged in a line and positioned to enable the flange to rest on the support pins when the manifold is supported by the manifold support.

7. The pump of claim 6, wherein the support pins comprise rollers.

8. The pump of claim 1, wherein the manifold support guides the manifold to move in a substantially straight path between the first and second position.

9. The pump of claim 1, wherein the manifold support guides the manifold, still supported, to move to a third position apart from the manifold mating surface and on an opposite side of the manifold mating surface from the second position.

10. The pump of claim 1, wherein the manifold support includes provisions to lock the manifold in the second position.

11. A method of servicing a pump, comprising:

disconnecting a manifold of the pump from a remainder of the pump;

supporting the manifold in an orientation adjacent a manifold mating surface on a manifold support of the pump; and displacing the manifold apart from the manifold mating surface while the manifold is supported in the same orientation on the manifold support.

12. The method of claim 11, wherein the manifold has a planar pump mating surface and the manifold mating surface is planar, and when upright, the pump mating surface is substantially parallel to the manifold mating surface.

13. The method of claim 11, wherein displacing the manifold from the manifold mating surface comprises moving the manifold along a track of the manifold support.

14. The method of claim 11, further comprising locking the manifold in a position apart from the manifold mating surface.

15. The method of claim 11, installing manifold supports to the pump, and using the manifold supports to support the manifold in the supporting and displacing steps.

16. A device attachable to a pump, the pump having a pump fluid end and a manifold that is detachable from the fluid end, the device comprising:

a manifold support beam portion adapted to affix to the pump fluid end at a location adjacent a manifold mating surface of the pump fluid end and extend outward from the pump fluid end; and a support on the manifold support beam portion that, when the manifold support beam portion is affixed to the fluid end of the pump, engages the manifold detached from the fluid end and supports the weight of the manifold in a first position with a pump body mating surface of the manifold adjacent a manifold mating surface and guides the manifold, still supported, to slide in a substantially straight path to a second position, apart from the manifold mating surface.

17. The device of claim 16, wherein the manifold support beam comprises a flange and the support comprises a track that engages upward facing and downward facing surfaces of the flange.

18. The device of claim 17, wherein the track comprises rollers.

19. The device of claim 16, wherein the manifold support beam is maintained upright in the first position and the second position.

20. The device of claim 16, wherein the manifold support beam includes provisions to lock the manifold in the second position.

* * * * *